US005657613A

United States Patent [19]

Quinones

[11] Patent Number: 5,657,613

[45] Date of Patent: Aug. 19, 1997

[54] METHOD AND SYSTEM FOR WRAPPING STEEL

[76] Inventor: Victor Manuel Quinones, 7123 Horizon Peak, San Antonio, Tex. 78233

[21] Appl. No.: 540,457

[22] Filed: Oct. 10, 1995

[51] Int. Cl.[6] ..... B65B 11/00

[52] U.S. Cl. ..... 53/409; 53/414; 53/461

[58] Field of Search ..... 53/409, 414, 461; 206/397, 398, 400, 403, 413, 414, 415, 416

[56] References Cited

U.S. PATENT DOCUMENTS

| | | | |
|---|---|---|---|
| 737,328 | 8/1903 | Boyle et al. . | |
| 744,467 | 11/1903 | Boyle et al. . | |
| 746,447 | 12/1903 | Boyle et al. . | |
| 1,933,661 | 11/1933 | Dale | 53/409 |
| 2,199,114 | 4/1940 | Rosenberg | 53/414 |
| 2,586,078 | 2/1952 | O'Malley | 53/409 |
| 2,910,814 | 11/1959 | Yelinek | 53/409 |
| 3,690,087 | 9/1972 | Jacobsen . | |
| 4,519,183 | 5/1985 | Parody | 53/461 |
| 4,524,562 | 6/1985 | Yagi et al. | 53/409 |
| 4,826,015 | 5/1989 | Mandel . | |
| 5,020,664 | 6/1991 | Hughes et al. | 206/397 |
| 5,456,062 | 10/1995 | Wechsler | 53/414 |

FOREIGN PATENT DOCUMENTS

| | | | |
|---|---|---|---|
| 0568101 | 12/1958 | Canada | 53/409 |
| 0029764 | 2/1991 | Japan | 206/397 |
| 5004627 | 1/1993 | Japan | 53/409 |
| 5097112 | 4/1993 | Japan | 53/409 |

*Primary Examiner*—John Sipos
*Assistant Examiner*—Ed Tolan
*Attorney, Agent, or Firm*—Richard C. Litman

[57] ABSTRACT

A method for wrapping a roll of steel or other coiled material which includes the selection of a tear-resistant sheet of proportions to accommodate a steel roll. The sheet is folded along lines parallel to its width, and holes are punched through the folded sheet at the upper and lower ends of the sheet, forming a plurality of upper holes and a plurality of lower holes. The sheet is unfolded and ropes or strings are threaded through each set of holes. A roll of steel is placed on the sheet and the sheet is wrapped circumferentially around the roll and secured with adhesive tape. The strings are then drawn tightly, pulling the sheet radially over the roll of steel such that the sheet overlaps the aperture of the core of the roll. The overlapping portions of the sheet are bent inside of the core, and inner diameter protectors are placed in the core to secure the sheet. A system for wrapping a roll of steel is also disclosed.

7 Claims, 7 Drawing Sheets

METHOD AND SYSTEM FOR WRAPPING STEEL

BACKGROUND OF THE INVENTION

1. Field of the Invention

The present invention relates to a method and system for wrapping rolled material, particularly a roll of steel.

2. Description of the Prior Art

The present invention relates to a method for wrapping tear-resistant paper or a layer of plastic around a roll of coiled material. The paper is secured around the material by tightening drawstrings threaded through the top and bottom of the paper. Heretofore, methods and systems for wrapping rolled material and cable are slow and do not provide moisture resistance in that they do not completely cover the roll.

Following are previously patented inventions which disclose related inventions having the above-noted limitations.

U.S. Pat. Nos. 737,328, 744,467, and 746,447, issued to H. C. Boyle et al. on Aug. 25, 1903, Nov. 17, 1903, and on Dec. 8, 1903, respectively, teach tubular covers for wire coils which are tightened over the coil and whose free ends are held together by laces, straps, or buckles.

U.S. Pat. No. 3,690,087, issued on Sep. 12, 1972 to Arnulv Moe Jacobsen, teaches a method of packaging cable in which two flexible members are attached to a mandrel on which a cable has been wound and attached to each other by rope laced through holes in flaps around the periphery of the flexible members.

U.S. Pat. No. 4,826,015, issued on May 2, 1989 to Ronald L. Mandel, teaches a material handling arrangement which includes a set of straps circumferentially wrapping a roll of material and a second set radially wrapped around the material.

In addition to lacking many of the benefits of the instant invention, these patents teach methods completely different from that instantly claimed. Thus, none of the above inventions and patents, taken either singly or in combination, is seen to describe the instant invention as claimed.

SUMMARY OF THE INVENTION

The invention is directed to a method for wrapping coiled material which includes the selection of a tear-resistant sheet of proportions to accommodate a steel roll. The sheet is folded along lines parallel to its width, and holes are punched through the folded sheet at the upper and lower ends of the sheet, forming a plurality of upper holes and a plurality of lower holes. The sheet is unfolded and ropes or strings are threaded through each set of holes. A roll of coiled material is placed on the sheet and the sheet is wrapped circumferentially around the roll and secured with adhesive tape. The strings are then drawn tightly, pulling the sheet radially over the material such that the sheet overlaps the aperture of the core of the roll. The overlapping portion of the sheet is folded inside of the core and inner diameter protectors are placed in the core to secure the sheet.

Accordingly, it is a principal object of the invention to present a method and system for quickly and easily wrapping steel or any other type of coiled material such that labor and the risk of accidents will be reduced.

It is another object of the invention to provide a method and system by which a roll of steel is completely covered such that it is protected from moisture.

It is a further object of the invention to provide a method by which the system for wrapping a steel or other type of roll is easily made.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
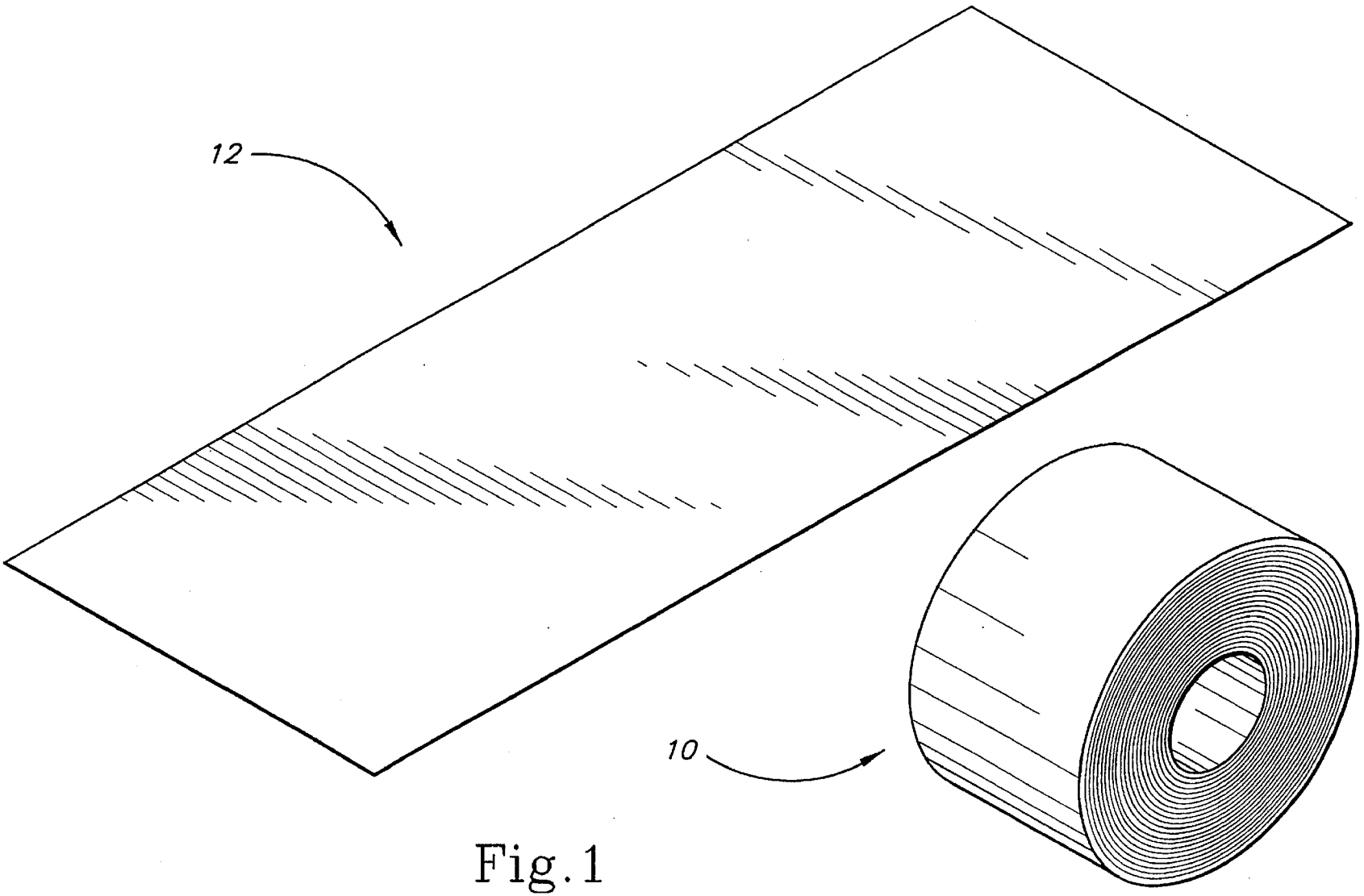
FIG. 1 a perspective view of a roll of steel next to a tear-resistant sheet.

The present invention relates to a method for wrapping a roll of steel 10 or any other type of coiled material in a tear-resistant sheet 12. A system for wrapping the steel is also presented. As seen in FIG. 1, a layer of a tear-resistant sheet 12, which can be made from paper and/or plastic (polyethylene or polypropylene), is provided. The sheet 12 has a length slightly greater than the periphery of the steel roll 10 and a width slightly greater than the sum of the length of the steel roll 10 and the difference between the inside diameter and the outside diameter of the steel roll 10.

By way of example, a steel roll that is 36 inches long, has an inside diameter of 20 inches, and an outside diameter of 60 inches, requires a sheet that is approximately 84 inches wide and 17 feet long. The length of the sheet, which is wrapped circumferentially along the steel roll, is calculated based on the periphery of the roll, $\pi d$. The width of the sheet, which is wrapped radially along the steel roll, is calculated based on the length of the cylinder plus the difference between the outside and inside diameters of the roll, i.e. L+OD−ID. Margins for overlap are allowed in the dimensions of the sheet by making the dimensions of the sheet slightly greater than the values calculated in the above relationships. Preferably, these calculated amounts are increased by approximately ten percent to allow for overlap. The importance of this overlap, particularly of the width of the sheet, will become apparent upon further description of the invention.

Figure 3:
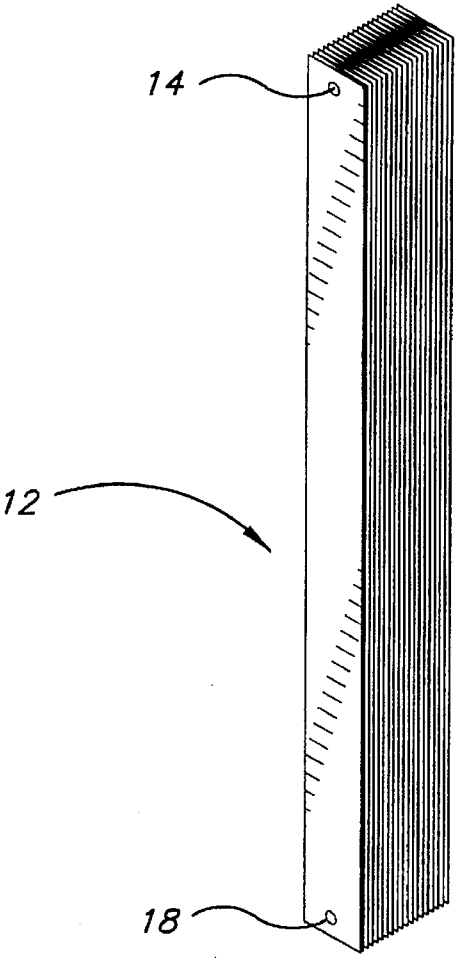
FIG. 3 a perspective view of a the tear-resistant sheet in which a hole has been punched through each of the top and bottom of the sheet.
Figure 2:
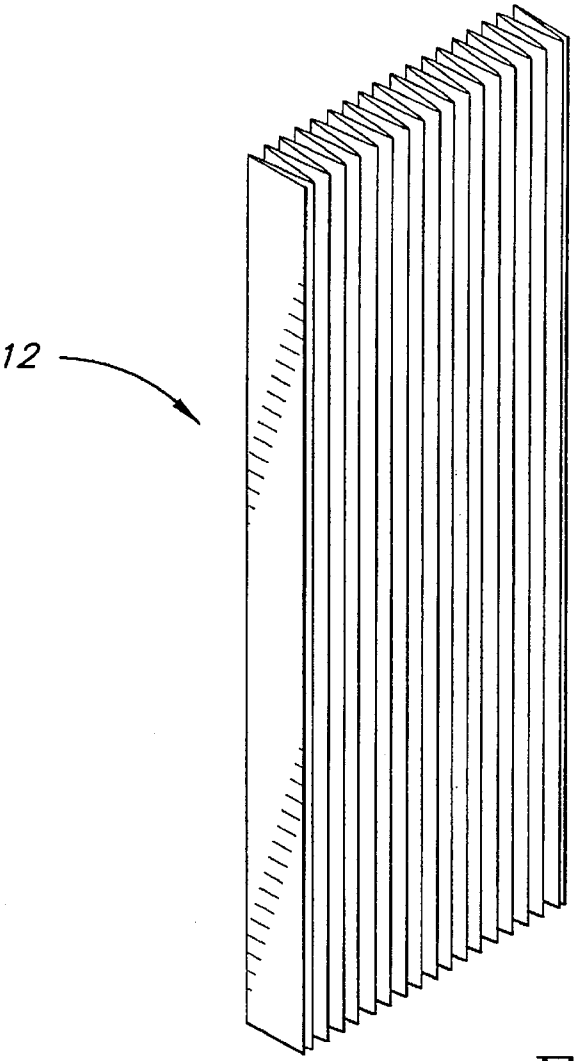
FIG. 2 is a perspective view of the tear resistant sheet 15 folded into a plurality of panels.

FIG. 2 shows the sheet 10 folded along lines parallel to its width into a plurality of panels. Although the length of the panels is not critical, by way of example, the sheet may be folded into 34 panels such that each panel maintains its width of 84 inches and is 6 inches long. As seen in FIG. 3, a hole 14 is punched through the upper portion of the panels, and a hole 6 is punched through the lower section of the panels. In keeping with the example immediately above, the upper holes are 6 inches apart and the lower holes are 6 inches apart. It is noted that this distance can be changed based on the way in which the sheet 12 is folded.

Figure 4:
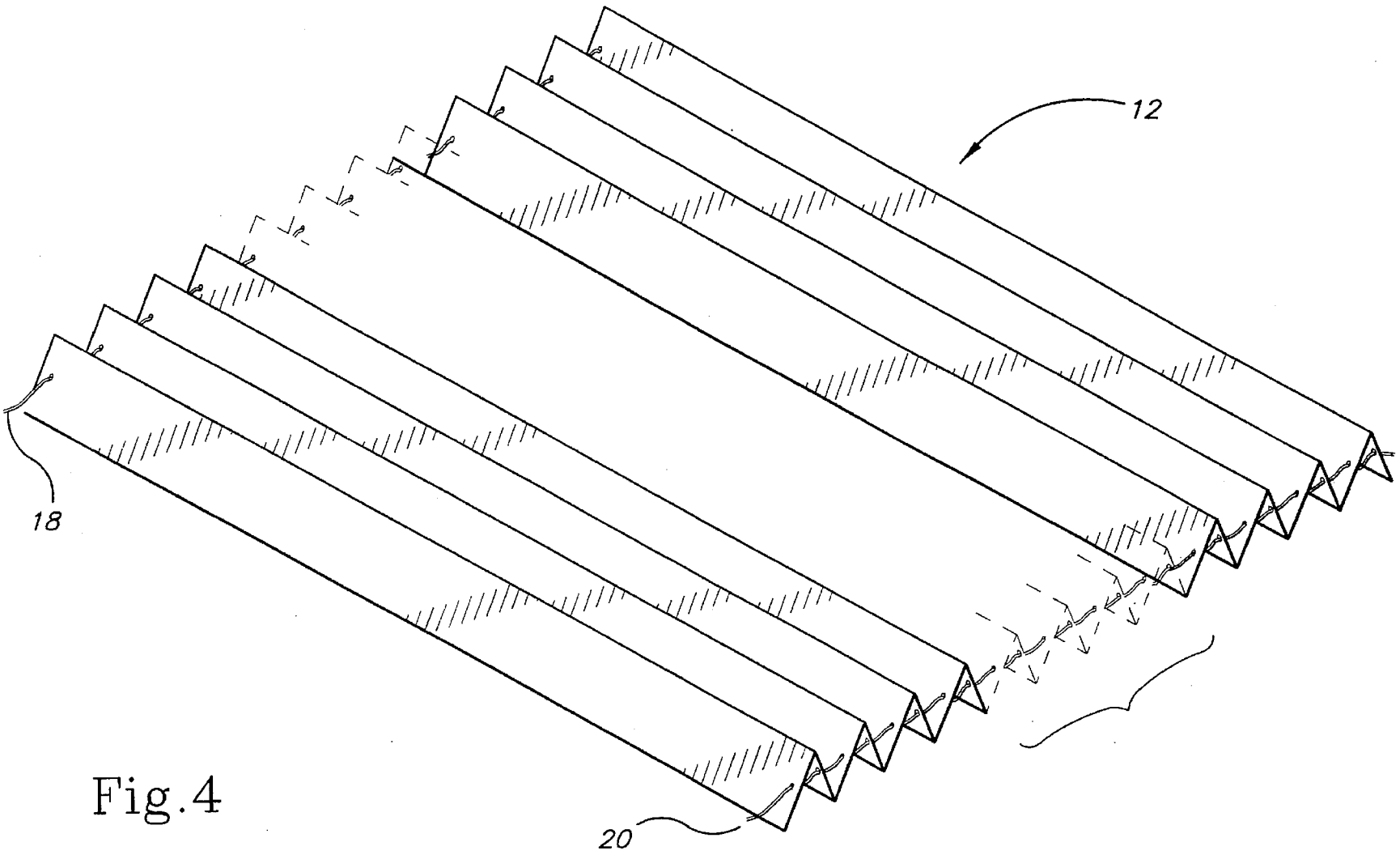
FIG. 4 is a perspective view of the sheet with a string laced through the bottom holes and a string laced through the top holes.
Figure 5:
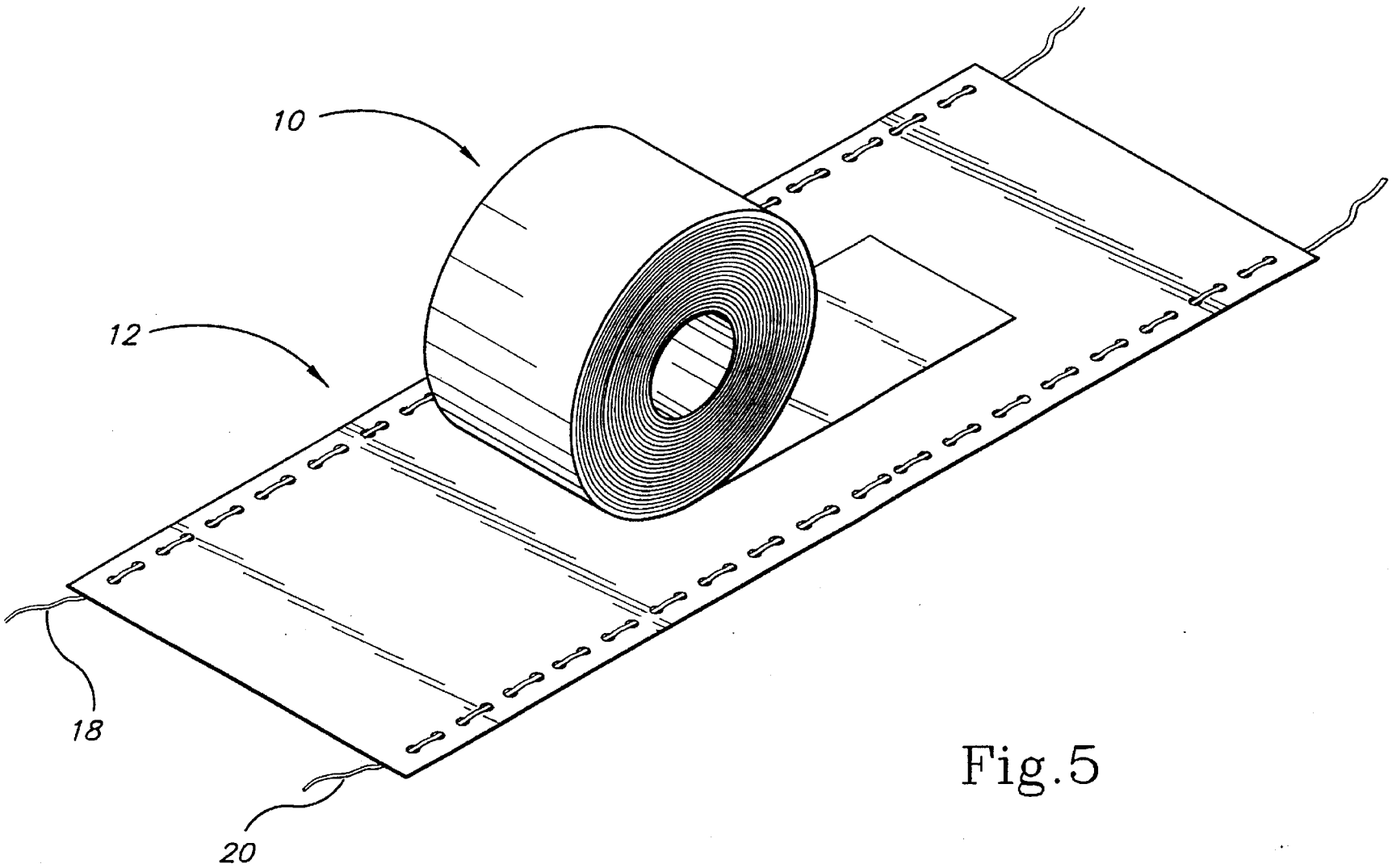
FIG. 5 is a perspective view of the sheet and the string with a roll of steel on top of the sheet.

FIG. 4 shows a string or rope 18 threaded through the upper holes and a string or rope 20 threaded through the lower holes. The sheet 12 is then straightened out and the roll of steel 0 is placed on the sheet and centered with respect to the length and width of the sheet (as seen in FIG. 5).

Figure 6:
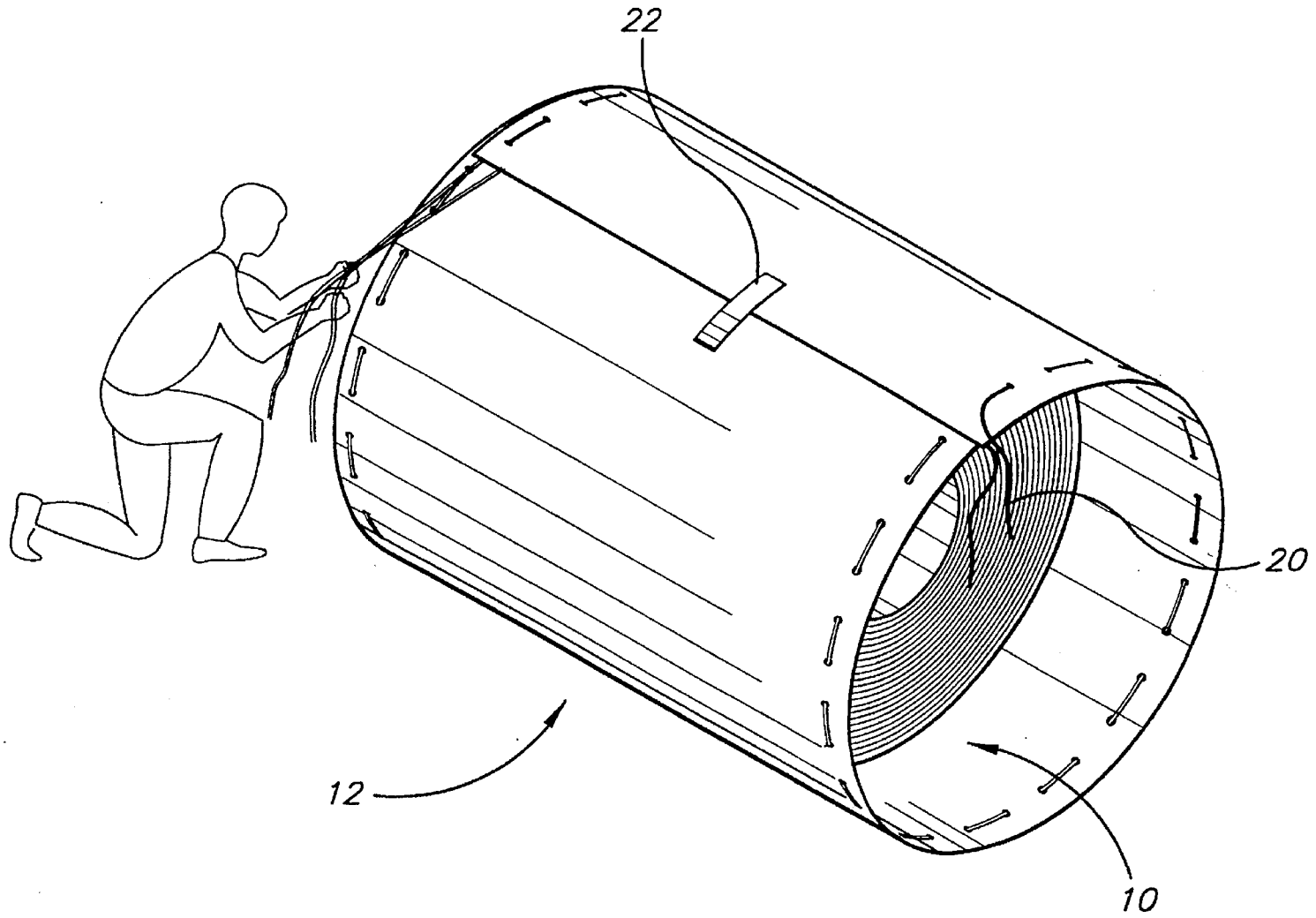
FIG. 6 is a perspective view of the sheet being rolled circumferentially around the steel.
Figure 7:
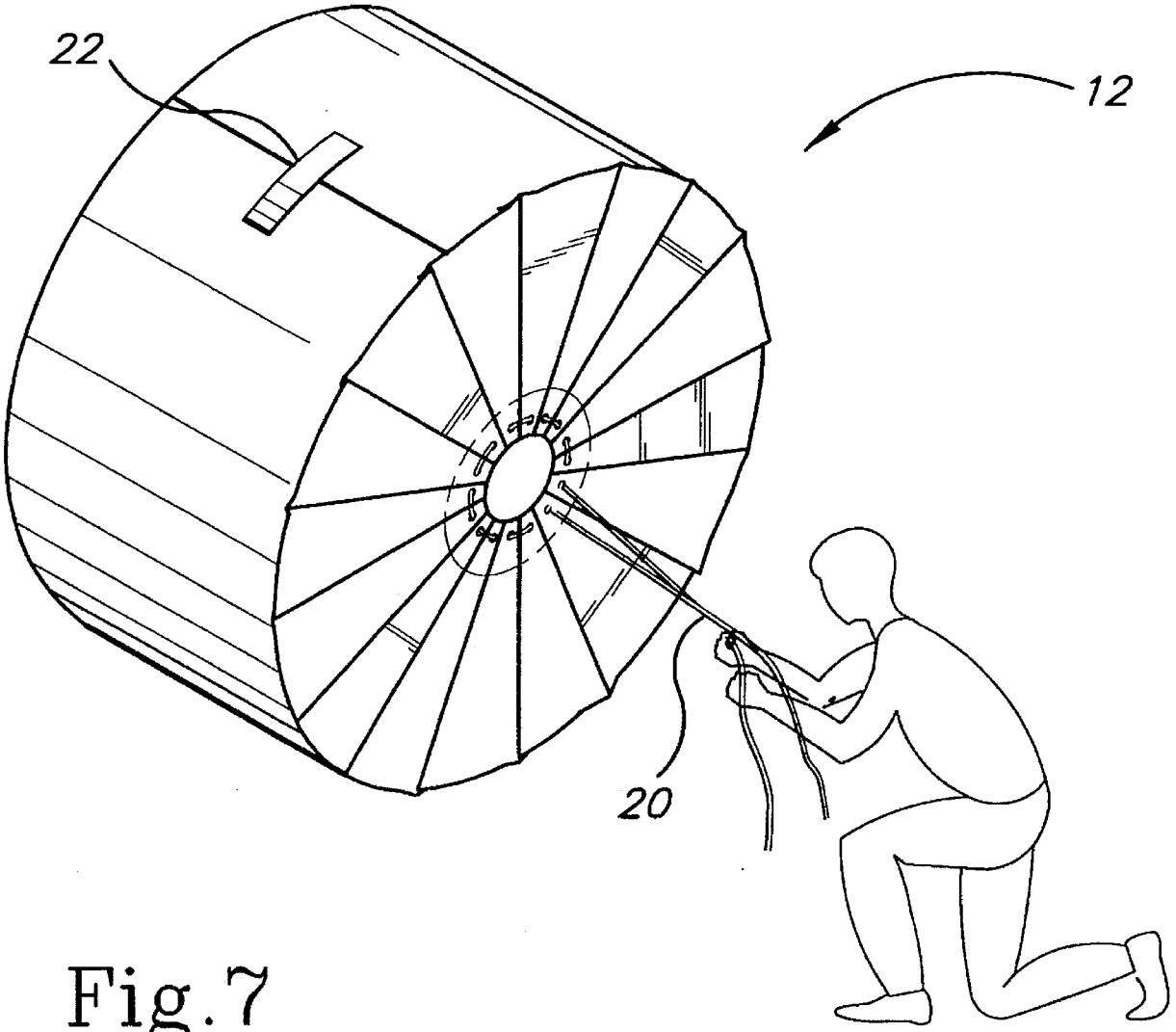
FIG. 7 is a perspective view of the sheet being drawn radially along the roll of steel.
Figure 8:
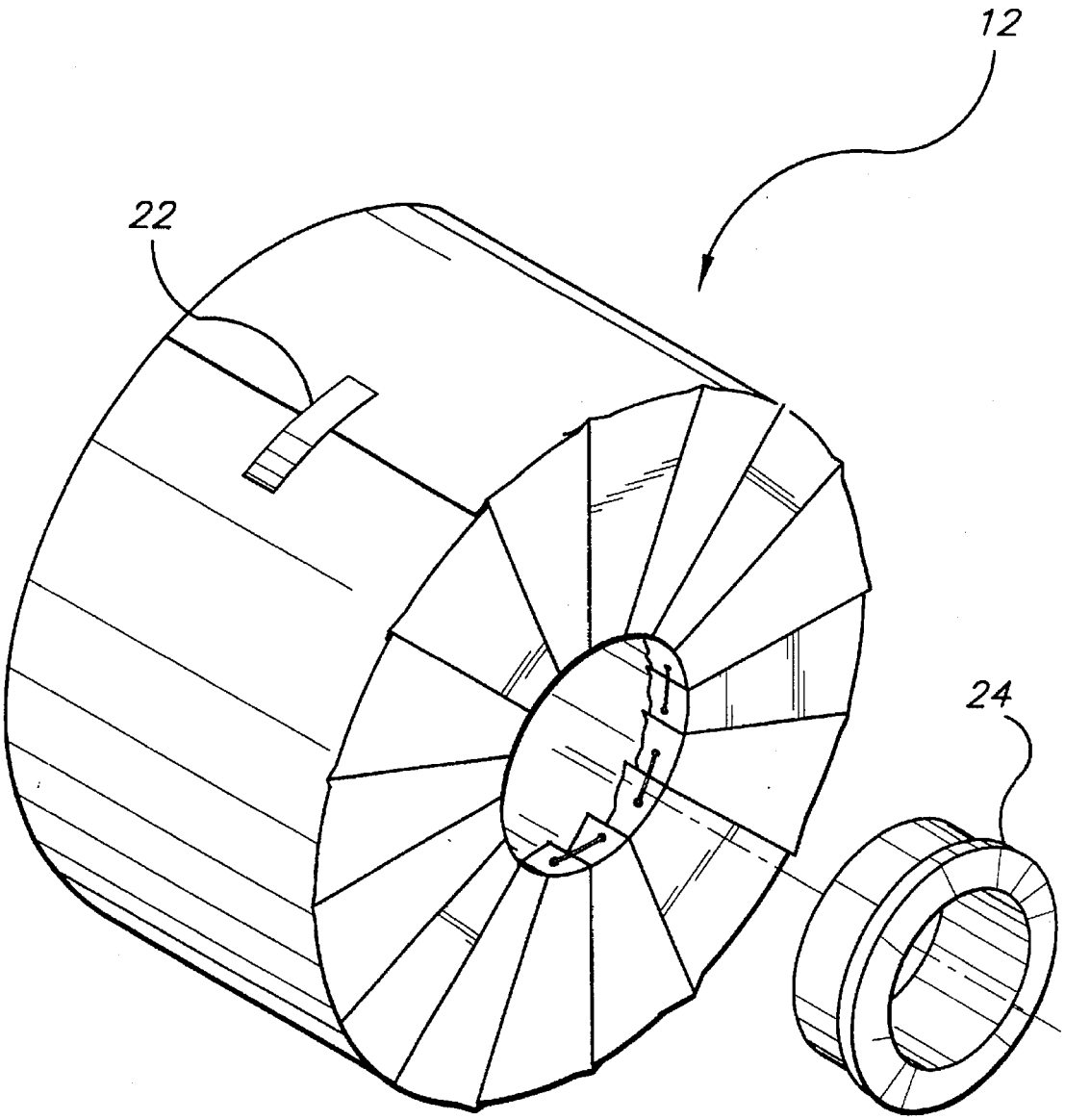
FIG. 8 is a perspective view of an inside diameter protect or being inserted into the core of the steel.

FIG. 6 shows that sheet 2 is wrapped circumferentially around the periphery of the roll of steel 10 and secured with a piece of adhesive tape 22. The string or rope 20 which runs through the lower holes is pulled tightly, causing the sheet 12 to radially cover the steel roll 10. As seen in FIG. 7, the sheet 12 overlaps the interior diameter of the steel roll 10. As shown in FIG. 8, this overlapping material is folded into the core of the steel roll 10 and secured against the steel roll by an inside diameter protector 24, which fits snugly into the steel roll. The steps of FIGS. 7 and 8 are then repeated for the other side of the steel roll, i.e. rope or string 18 is pulled tightly and an inside diameter protector is used on the other side of the steel roll.

It is to be understood that the present invention is not limited to the sole embodiment described above, but encompasses any and all embodiments within the scope of the following claims.

I claim:

1. A method of wrapping a cylindrical roll of coiled material comprising:

folding an elongated sheet having top, bottom, right, and left ends, along its width a plurality of times so that a plurality of panels having top and bottom portions are formed, punching a hole through the top portion and a hole through the bottom portion of each of the panels such that a top and bottom hole are made in each panel, threading a string or rope through the top hole in each panel and threading a string or rope through the bottom hole in each panel, such that the strings or ropes extend along the length of the sheet at the top and bottom ends of the sheet, placing a cylindrical roll of coiled material completely on the sheet, the cylindrical roll including an upper and a lower end, an outer periphery, and a central aperture defining an inner periphery at the upper and lower ends, wrapping at least one of the left and right ends of the sheet circumferentially around the outer periphery of the roll, pulling the string or rope towards the center of the coiled material at both the upper and lower ends of the coiled material, such that the sheet radially comes together to cover the coiled material at both its upper and lower ends and to form a circular aperture of smaller diameter than the diameter of the central aperture of the roll and overlaps the central aperture in the coiled material, and placing a rigid protector within the central aperture at both the upper and lower ends of the coiled material to force a portion of said sheet which overlaps the coiled material against the inner periphery of the coiled material.

2. The method of claim 1 further comprising the step of providing a sheet of specific dimensions.

3. The method of claim 1 further comprising providing a sheet having a width slightly greater than the sum of the length of the coiled material and the difference between the inside diameter of the coiled material and the outside diameter of the coiled material, and having a length slightly greater than the periphery of the coiled material.

4. The method of claim 3 further comprising the step of measuring the length, inside diameter, and outside diameter of the coiled material and calculating the size of the sheet required to accommodate the roll.

5. The method of claim 1 further comprising the step of measuring the length, inside diameter, and outside diameter of the coiled material and calculating the size of the sheet required to accommodate the roll.

6. A method of wrapping a cylindrical roll of steel comprising:

providing a cylindrical roll of steel having an outer periphery, a central aperture defining an inner periphery and having an inside diameter, an outside diameter and, a length, providing a rectangular sheet of a tear-resistant material having a width slightly greater than the sum of the length of the steel roll and the difference between the inside diameter of the steel roll and the outside diameter of the steel roll, and having a length slightly greater than the outer periphery of the steel roll, the ends of the sheet across its width being defined as top and bottom ends and the ends across its length being defined as left and right ends, folding the sheet along its width a plurality of times so that a plurality of panels having top and bottom portions corresponding to the top and bottom portions of the sheet are formed, punching a hole through the top portion and a hole through the bottom portion of each of the panels such that a top hole and a bottom hole are made in each panel, threading a string or rope through the top hole in each panel and threading a string or rope through the bottom hole in each panel, such that the strings or ropes extend along the length of the sheet at the top and the bottom of the sheet, placing the cylindrical roll completely on the sheet such that the length of the roll is across the width of the sheet and the roll is in the center of the sheet with respect to the width of the sheet, wrapping at least one of the left and right ends of the sheet around the periphery of the roll, taping the overlap of the two ends of the sheet with adhesive tape, pulling the string or rope on the top and bottom ends of the sheet towards the central aperture of the steel roll such that the sheet comes together to form a circular aperture of smaller diameter than the diameter of the central aperture of the roll and overlaps the central aperture in the steel roll, and placing an inside diameter protector inside each end of the central aperture of the steel roll to force the portion of the sheet overlapping the steel roll against the inner periphery of the steel roll.

7. The method of claim 6 further comprising the step of measuring the length, inside diameter, and outside diameter of the steel roll and calculating the size of the sheet required to accommodate the roll.

* * * * *